US007992259B2

(12) United States Patent
Goldstein et al.

(10) Patent No.: US 7,992,259 B2
(45) Date of Patent: Aug. 9, 2011

(54) TENSION REDUCER FOR CABLE WRAP SECURITY DEVICE

(75) Inventors: Mitchell S. Goldstein, Rock Hill, SC (US); Andrew W. Moock, Brecksville, OH (US); Christopher J. Fawcett, Charlotte, NC (US)

(73) Assignee: Checkpoint Systems, Inc., Philadelphia, PA (US)

( * ) Notice: Subject to any disclaimer, the term of this patent is extended or adjusted under 35 U.S.C. 154(b) by 471 days.

(21) Appl. No.: 12/101,471

(22) Filed: Apr. 11, 2008

(65) Prior Publication Data

US 2008/0251623 A1 Oct. 16, 2008

Related U.S. Application Data

(60) Provisional application No. 60/923,368, filed on Apr. 13, 2007.

(51) Int. Cl.
*E05B 43/00* (2006.01)

(52) U.S. Cl. ..... 24/18; 24/71 CT; 24/69 WT; 24/115 R; 242/398

(58) Field of Classification Search ..... 24/132 AA, 24/132 R, 115 R, 69 WT, 69 SK, 71 CT; 242/398, 419.6, 419.7
See application file for complete search history.

(56) References Cited

U.S. PATENT DOCUMENTS

| | | | | |
|---|---|---|---|---|
| 3,611,760 | A | 10/1971 | Muther | |
| 4,418,551 | A | 12/1983 | Kochackis | |
| 4,756,171 | A | 7/1988 | Homar | |
| 4,896,517 | A | 1/1990 | Ling | |
| 4,930,324 | A | 6/1990 | Meier | |
| 5,156,028 | A | 10/1992 | Jiang | |
| 5,647,107 | A * | 7/1997 | Brewster | 24/713.6 |
| 5,794,464 | A * | 8/1998 | Yeager et al. | 70/57 |
| 6,092,401 | A | 7/2000 | Sankey et al. | |
| 7,162,899 | B2 | 1/2007 | Fawcett et al. | |
| 7,331,126 | B2 * | 2/2008 | Johnson | 36/50.1 |
| 7,685,850 | B2 * | 3/2010 | Nilsson | 70/18 |
| 2006/0053659 | A1 * | 3/2006 | Johnson | 36/56 |

* cited by examiner

*Primary Examiner* — Robert J Sandy
*Assistant Examiner* — Michael Lee
(74) *Attorney, Agent, or Firm* — Sand & Sebolt

(57) ABSTRACT

A security device includes a housing containing a ratchet mechanism and a rotatable spool for storing a plurality of cable loops which extend outwardly from a plurality of openings formed in the housing and wrapped around the sides of a box-like object. A collar is mounted on the bottom of the housing and has openings adjacent each of the housing opening requiring the cable loops to abruptly change direction after exiting the housing and passing either beneath or above the collar before extending along the secured object. This abrupt change of direction reduces the amount of force which are exerted on the cable loops from being transmitted onto the ratchet mechanism. In alternate embodiments, adjacent cable loops pass through one or a pair of rings which cause a change of direction in the cable loops to reduce the transmission of forces onto the ratchet mechanism.

11 Claims, 9 Drawing Sheets

TENSION REDUCER FOR CABLE WRAP SECURITY DEVICE

CROSS REFERENCE TO RELATED APPLICATIONS

This application claims priority from U.S. Provisional Application Ser. No. 60/923,368 filed Apr. 13, 2007; the disclosure of which is incorporated herein by reference.

BACKGROUND OF THE INVENTION

1. Technical Field

The invention relates to a security device, and more particularly, to a security device which wraps around and secures a box-like structure in a secure locked position. Even more particularly, the invention relates to such a cable security device which includes a device that reduces a force which is applied to the cable loops from being fully transmitted to a spool and ratchet mechanism within the security device to prevent malfunction of the ratchet mechanism.

2. Background Information

Retail stores have a difficult time protecting objects such as boxes containing various expensive merchandise, books and other similarly structured packages, or protecting such containers from being opened and the contents thereof being removed without authorization from store personnel or damaged while on display. Consumers often want to visually inspect the packaged expensive articles before deciding to purchase them. The store is faced with the problem of how to protect these expensive articles from theft while displaying them for sale.

One manner used to protect these packages and the articles contained therein is to enclose the article within a transparent glass display case which can only be accessed from behind a counter of the retail store. The consumer can view the article through the glass but is not able to handle the article or read any of the information about the article that may be printed on the box unless a store clerk removes the article from the case. However, in large retail stores, the problem then arises of getting the selected merchandise to the customer after the customer wishes to purchase the same without subjecting the merchandise to theft. One manner is to maintain a supply of the boxes containing the expensive articles or merchandise close at hand for delivery to or pick-up by the customer for subsequent taking to a check-out clerk. However this makes the boxes susceptible to theft and requires additional sales personnel.

Another manner used by retail stores is to list the article in a catalog and require consumers to place an order from the catalog. The article is delivered from a back storage area and the consumer must simultaneously pick up and pay for the merchandise at the same location to prevent unauthorized removal from the store. The consumer does not get to inspect the article before purchasing and if they are not satisfied they must undergo the hassle of returning the article for a refund.

Boxes and similar objects are also subjected to unauthorized openings while being shipped via a courier. These objects can be easily opened and resealed when packaged and taped-shut in the conventional manner without the recipient or the sender knowing of such actions. Shipped packages can be secured within a security container with a locking mechanism but these containers are expensive to purchase and add size and weight to the package making it more expensive to ship. Also, would-be thieves can gain unauthorized access to the contents of these containers by "picking" the locking mechanisms or possibly guessing the combination to a combination lock.

Many of these problems are solved by using a security device which includes a cable and an internal spool and ratchet mechanism for tightening a plurality of cable loops about the object to be protected. Some examples of these prior art security devices are shown in U.S. Pat. Nos. 3,611,760, 4,418,551, 4,756,171, 4,896,517, 4,930,324, 5,156,028, 5,794,464, 6,092,401, and 7,162,899.

However, it has been discovered that if an abrupt force is exerted on the cable loops, such as by lifting a heavy package by the security device and simulating a sudden dropping of the package while continuing to grasp the security device, it would exert a large abrupt force on the cable loops that is transmitted directly to the internal ratchet mechanism possibly causing breakage of the ratchet mechanism enabling the cable to unwind freely from the cable storage spool mounted within the security device exposing the protected object to unauthorized entry or removal of the security device cable loops therefrom due to the unwinding of the cable loops from the internal spool of the security device.

Therefore, the need exists for a cable wrap security device which includes a ratchet mechanism for securing a plurality of cable loops which are placed about an object under sufficient tension to prevent their removal from the object and which is provided with a tension reducing device which prevents large abrupt forces exerted on the cable loops from being exerted directly onto the internal ratchet mechanism and cable storage spool to prevent breakage of the ratchet mechanism and possibly unwinding of the cable loops from around the protected object.

BRIEF SUMMARY OF THE INVENTION

The security device of the present invention is a cable wrap security device having an internal ratchet mechanism which controls a spool on which a plurality of cable loops are installed, whereby the cable loops extend outwardly from the housing of the security device for placement about an object to secure the object in a closed locked position.

Another feature is to provide such a security device with a tension reducer which operatively engages one or more of the cable loops as they extend outwardly from the housing and provides an abrupt change in direction of the cable loop and increased friction on the cable loops whereby a large force suddenly exerted on the cable loops is reduced considerably before the force is transmitted onto the internal ratchet mechanism within the housing thereby protecting the ratchet mechanism from damage and possible failure.

Another feature of the present invention is to provide the tension reducer as an adapter which is easily retrofitted onto existing cable wrap security devices which is in the form of a collar that is snap-fitted onto the bottom of the security device, which adapter requires the cable loops upon exiting the ratchet housing to pass beneath the collar before extending along the protected object thereby providing the abrupt change in the direction of the cable loops, or which directs the loops between the collar and bottom of the housing along projections formed on the collar to increase the amount of friction exerted on the loops immediately after exiting the spool housing to reduce the amount of force exerted on the ratchet mechanism.

A further feature of the present invention is to provide the cable tension reducer as a simple ring-like member through which one or two pairs of the cable loops pass upon exiting the ratchet housing before extending along the protected object thereby providing for the desired change in direction of the cable loops to appreciably reduce the amount of force transmitted from the cable loops onto the internal ratchet mechanism of the security device.

A still further aspect of the invention is to form the cable tension reducer as an integral part of the ratchet housing, a snap-on adapter, or as a ring not part of the actual security device, all of which will change the direction of the cable loops, for example, by requiring the cable loops to move through an approximately 90° or 180° change in direction, immediately after the cable loops exit the ratchet housing.

These features and advantages are obtained by the improved security device of the present invention which is adapted to be placed on an object to prevent said object from being opened, said device comprising a housing; a plurality of cable loops extending outwardly from the housing for placement about the object; a ratchet mechanism located within the housing and operatively connected to the cable loops, said ratchet mechanism operatively connected to a rotatable spool for maintaining the cable loops tensioned around the object; a plurality of openings formed in the housing for passage of the cable loops therethrough for placement about the object; and a tension reducing device operatively engageable with certain of the cable loops generally adjacent certain of the housing openings for abruptly changing the direction of said certain cable loops after passing of said loops in a generally tangential direction out of the housing openings prior to said loops extending about the object.

BRIEF DESCRIPTION OF THE SEVERAL VIEWS OF THE DRAWINGS

Preferred embodiments of the invention, illustrated of the best modes in which Applicant contemplates applying the principles, are set forth in the following description and are shown in the drawings and are particularly and distinctly pointed out and set forth in the appended claims.

Similar numbers refer to similar parts throughout the drawings.

DETAILED DESCRIPTION OF THE INVENTION

Figure 1:
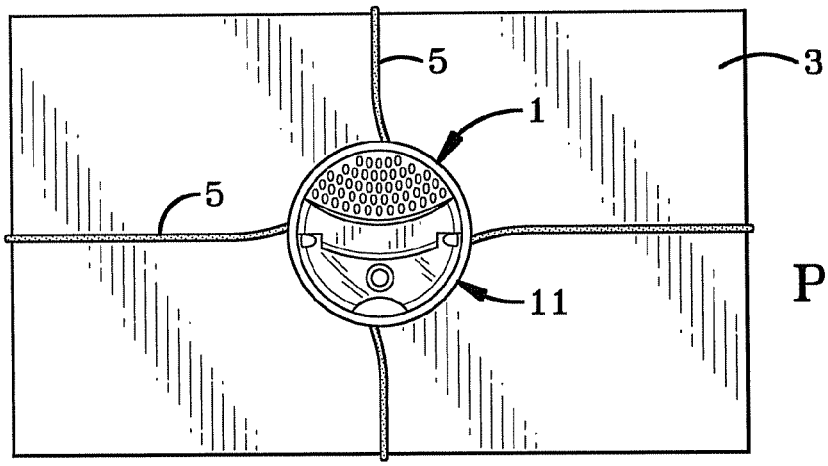
FIG-1 PRIOR ART
FIG. 1 is a top plan view showing the prior art cable wrap security device mounted and secured on an object.
Figure 2:
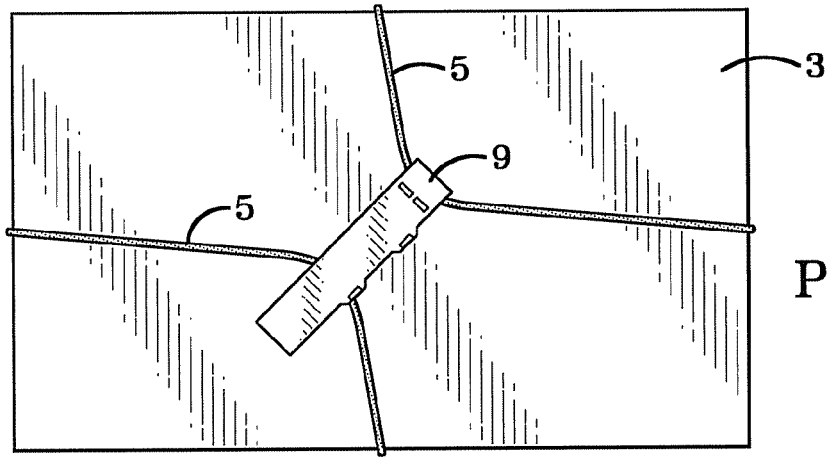
FIG-2 PRIOR ART
FIG. 2 is a back plan view of the prior art cable wrap security device secured on an object.
Figure 3:
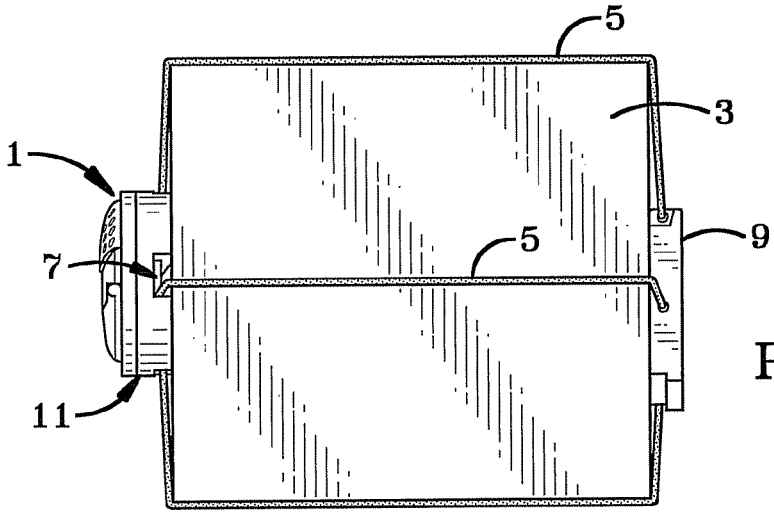
FIG-3 PRIOR ART
FIG. 3 is a right side elevational view of the prior art security device shown in FIG. 1.

FIGS. 1-7 show a prior art cable wrap security device of which the present invention is an improvement thereon. The cable wrap security device is indicated generally at 1, and is shown mounted on a usual box-like six-sided object 3. A plurality of cable loops 5 extend outwardly from side wall openings 7 formed in a cylindrical housing 11 of the cable wrap security device. Cable wrap security device 1 may include a locking member 9 which will be located on the opposite side of object 3 than housing 11. Locking member 9 may be opened by a magnetic key or other type of unlocking device. Security device 1 may be of the type shown and described in U.S. Pat. No. 7,162,899 the contents of which are incorporated herein by reference. However, it may have other constructions than that shown in the above-mentioned patent and shown particularly in FIGS. 1-7 without affecting the concept of the invention.

Security device 1 will include a ratchet mechanism which is indicated generally at 13, located within housing 11. Ratchet mechanism 13 will include a spool 15 having a pair of spaced annular flanges 17 and 19, which form a storage area therebetween for storing cable loops 5 which are attached in some manner to spool 15. The ratchet mechanism includes an outer ring 21 formed with a plurality of one-way gear teeth 23 which are adapted to be engaged by gear teeth 25 formed on a plurality of outwardly extending locking pawls 27 to secure the ratchet mechanism in a locked position after the spool has been rotated in the locking direction, such as by use of a flip-up handle 29 or other type of tightening mechanism such as described in U.S. Pat. Nos. 5,722,266 and 7,162,899, the contents of which are incorporated herein by reference. Further details and operation of ratchet mechanism 13 are well-known in the art and are described in the above-mentioned U.S. Pat. No. 7,162,899. However, other types of ratchet mechanisms for tightening the cable loops about object 5 can be utilized.

Figure 5:
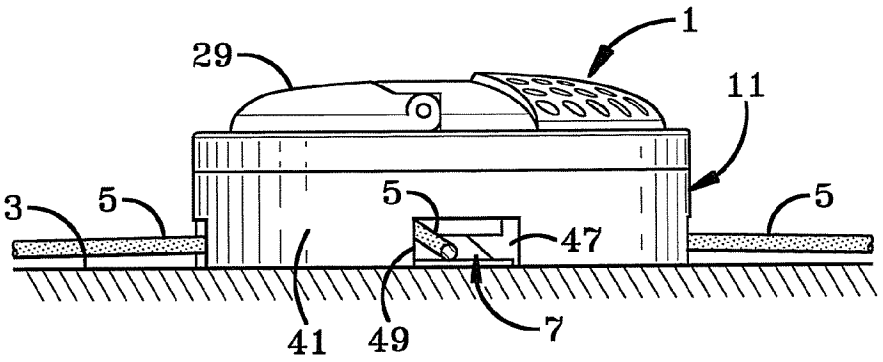
FIG-5 PRIOR ART
FIG. 5 is a side elevational view of the prior art as shown in FIG. 4.
Figure 4:
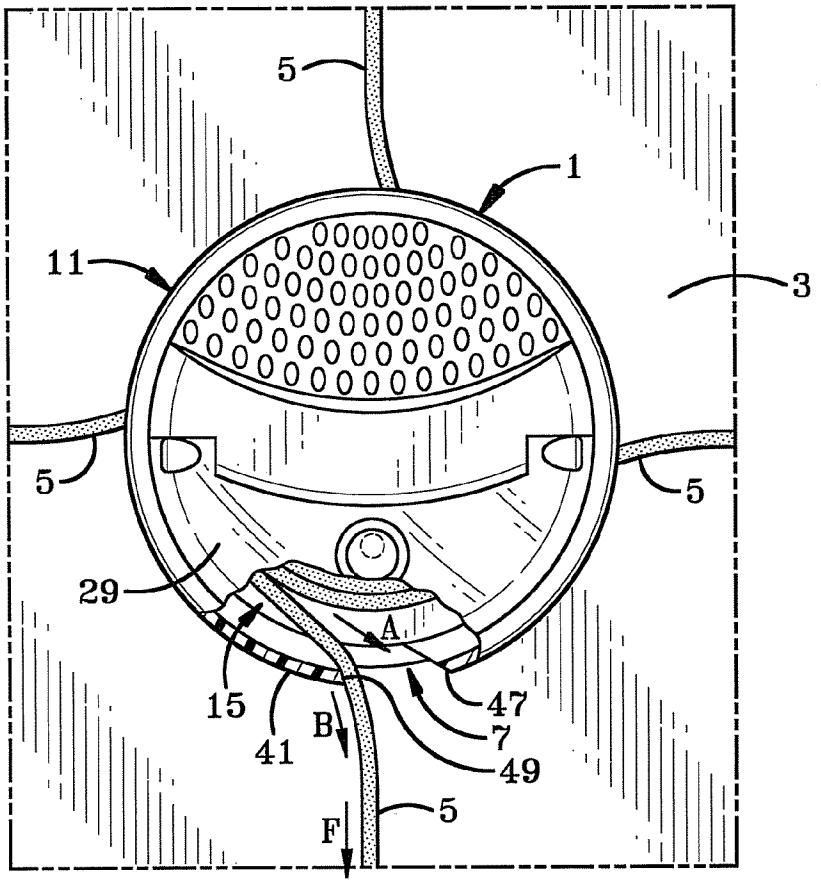
FIG-4 PRIOR ART
FIG. 4 is an enlarged top plan view of the prior art security device with portions broken away mounted on the object as shown in FIG. 1.
Figure 6:
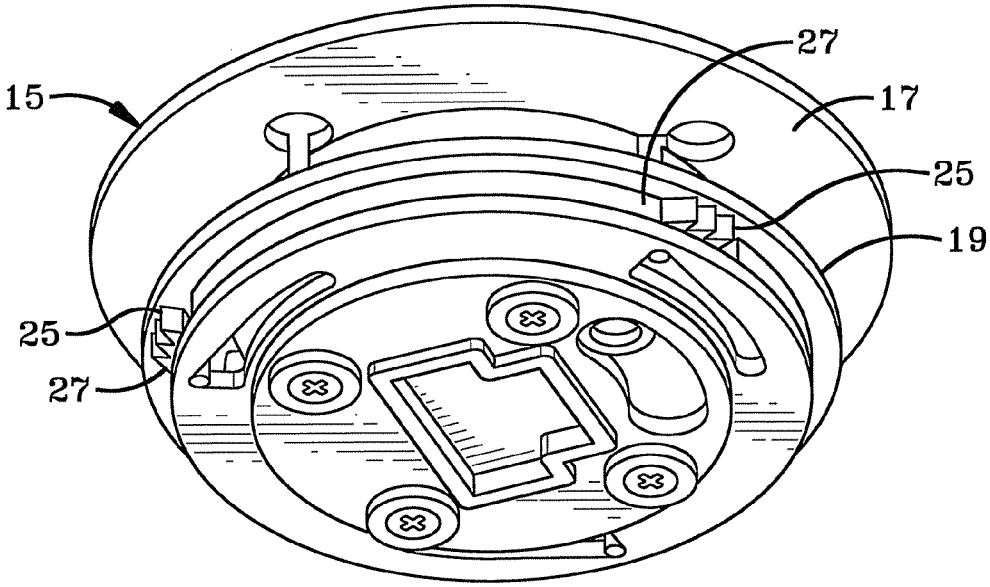
FIG-6 PRIOR ART
FIG. 6 is a perspective view of a portion of one type of ratchet mechanism used in the security device of the present invention.
Figure 7:
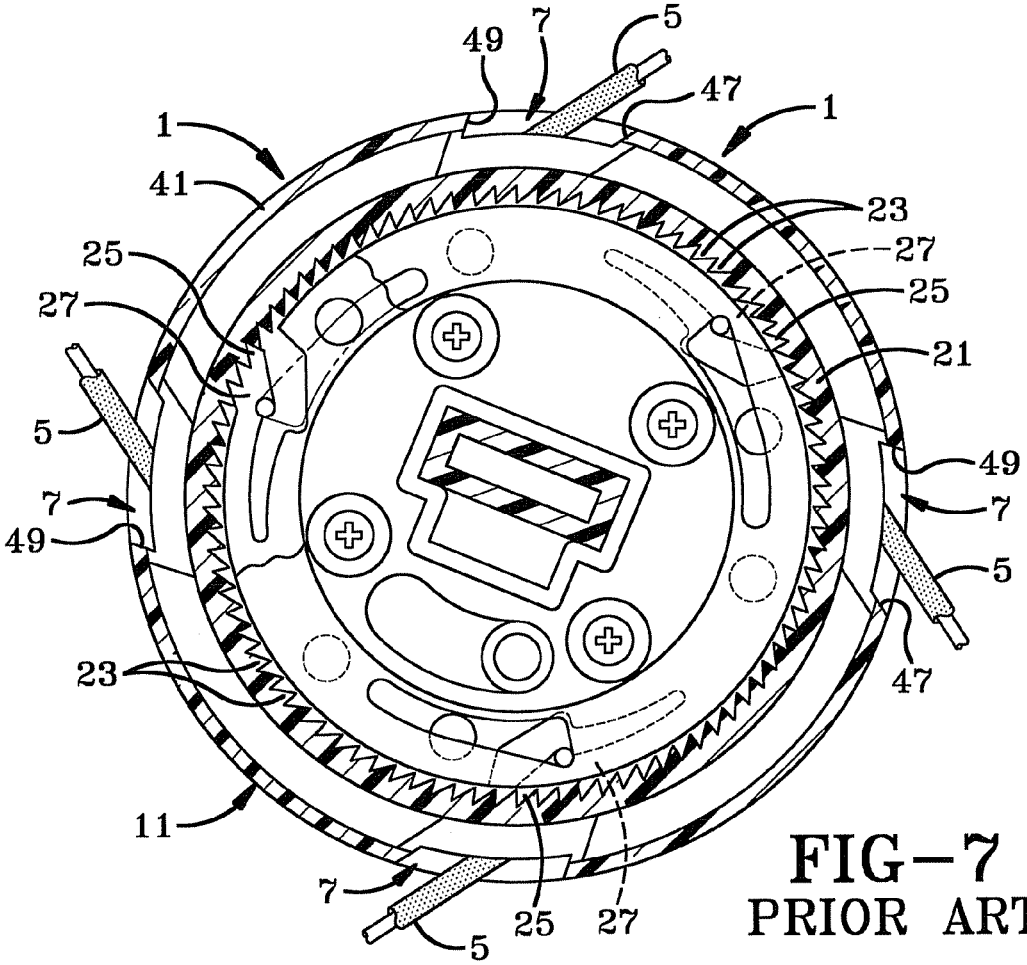
FIG-7 PRIOR ART
FIG. 7 is a sectional view of the ratchet mechanism shown in FIG. 6 mounted within the outer housing of the security device.
Figure 8:
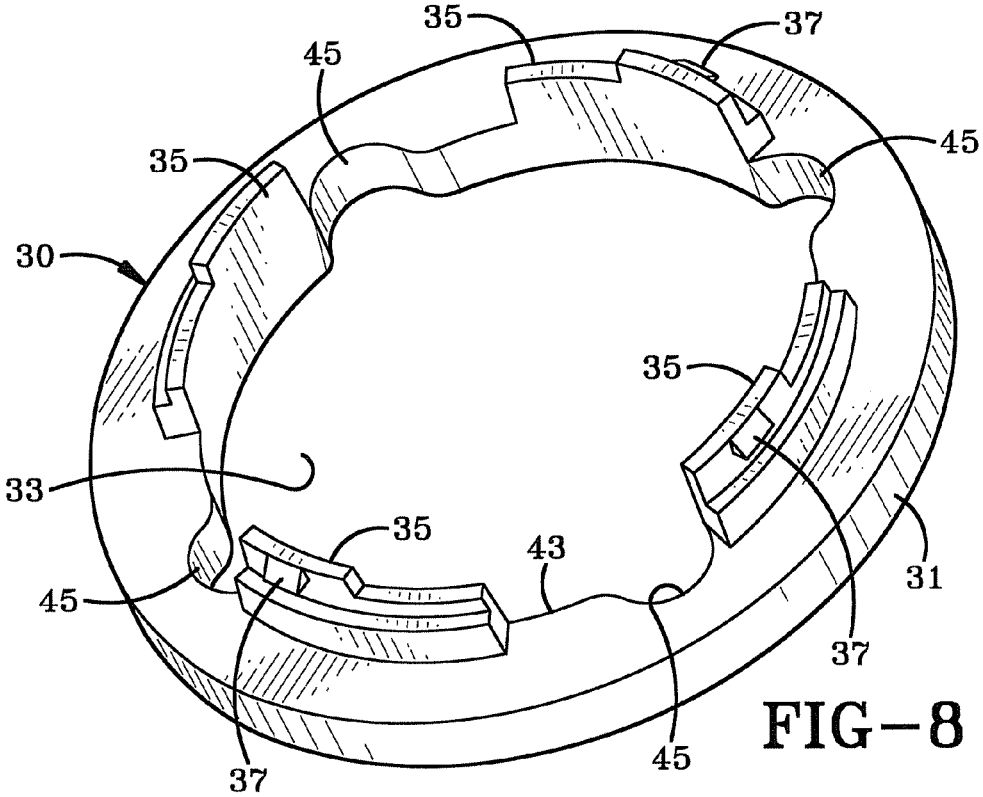
FIG. 8 is a top perspective view of the tension reducing collar of the present invention.
Figure 9:
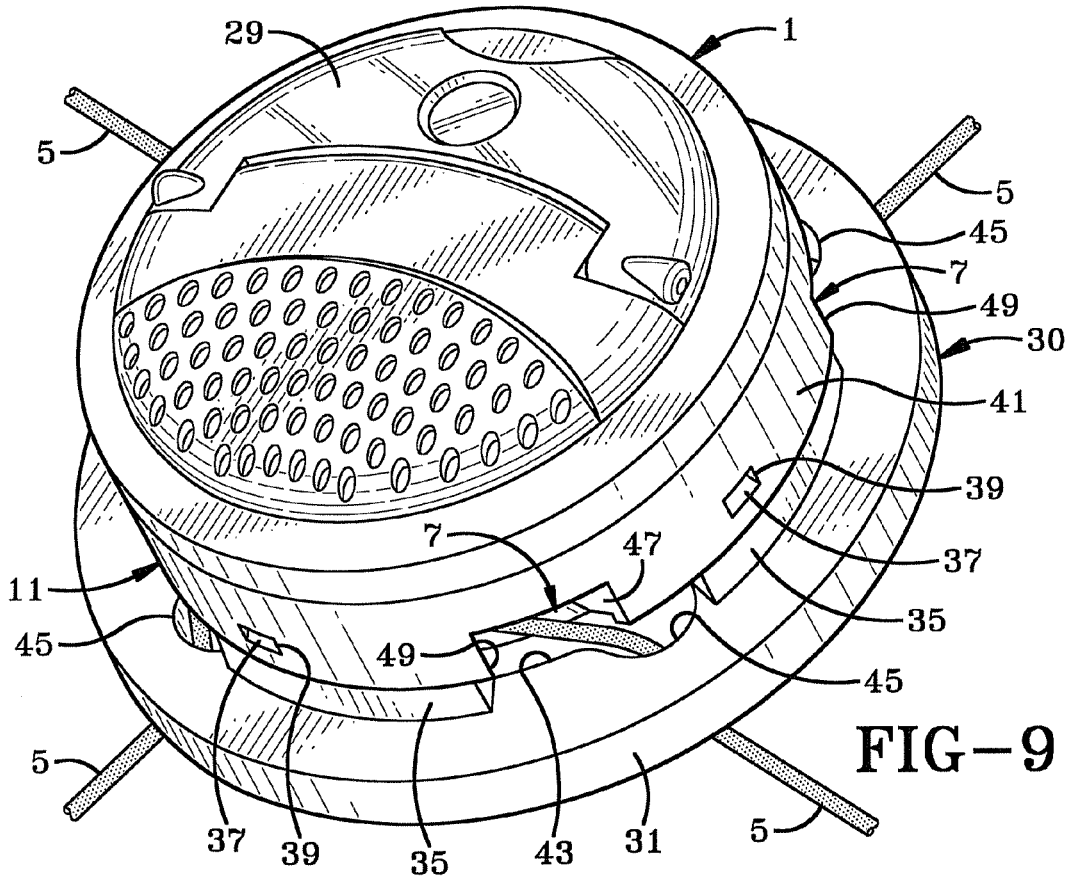
FIG. 9 is a top perspective view of the tension reducing collar of FIG. 8 mounted on a cable wrap security device.

After the loosened cable loops 5 are placed about object 3, the ratchet mechanism is rotated in the locking direction by flip-up handle 29 or other type of tightening mechanism, to place sufficient tension on the cable loops to prevent them from unloosening due to the engagement of locking pawl gear teeth 25 with gear teeth 23 until released by some type of release mechanism. When in this tightened position, cable loops 5 extend outwardly through housing opening 7 as shown in FIGS. 4, 5 and 7 in a generally straight-line tangential fashion from spool 15 as shown by Arrow A (FIG. 4), after which the cable moves in a straight line fashion as shown by Arrow B as it extends about an edge 49 of opening 7 and then along the outer surface of object 3.

It is readily seen that a large force when suddenly exerted on cable 5 as represented by Arrow F (FIG. 4) will be exerted partially onto edge 49 of housing opening 7 and then directly onto the spool and correspondingly on ratchet mechanism 13. When this force is sufficiently large and abrupt it has been found to break the engagement of gear teeth 25 with gear teeth 23 causing the locking pawls to move out of engagement with the gear teeth of outer housing ring 21 providing a generally free-wheeling effect to the cable and internal spool enabling a would-be thief to easily remove cable loops 5 from about object 3. When this large force is exerted partially onto opening edge 49, it will cause housing 11 to rotate slightly transmitting more of the force directly onto the cable spool.

Figure 11:
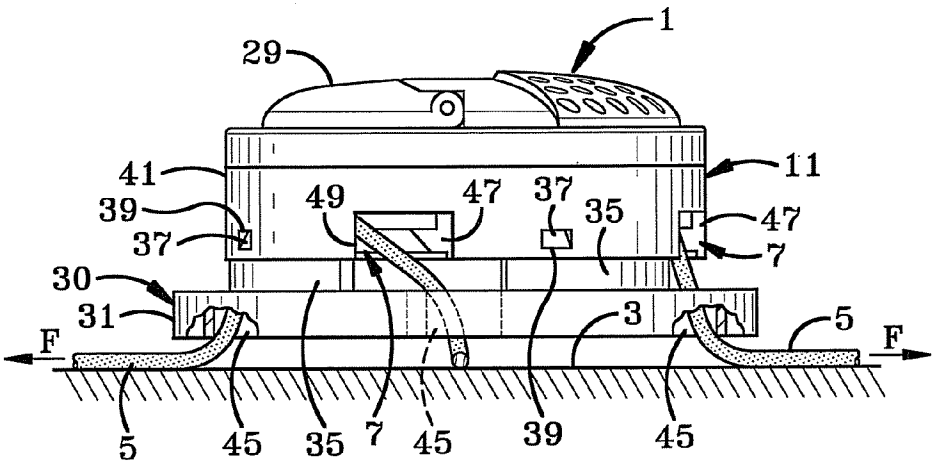
FIG. 11 is a side elevational view of the cable wrap security device including the tension reducing adapter shown in FIGS. 9 and 10.
Figure 10:
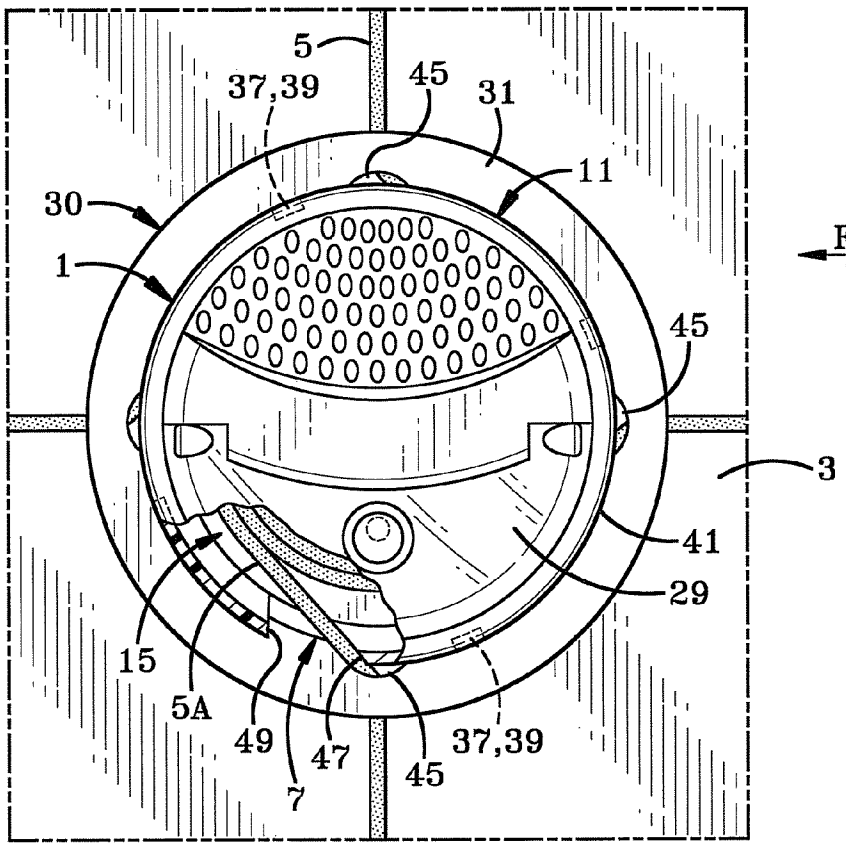
FIG. 10 is a top plan view of FIG. 9 with portions broken away and in section.
Figure 12:
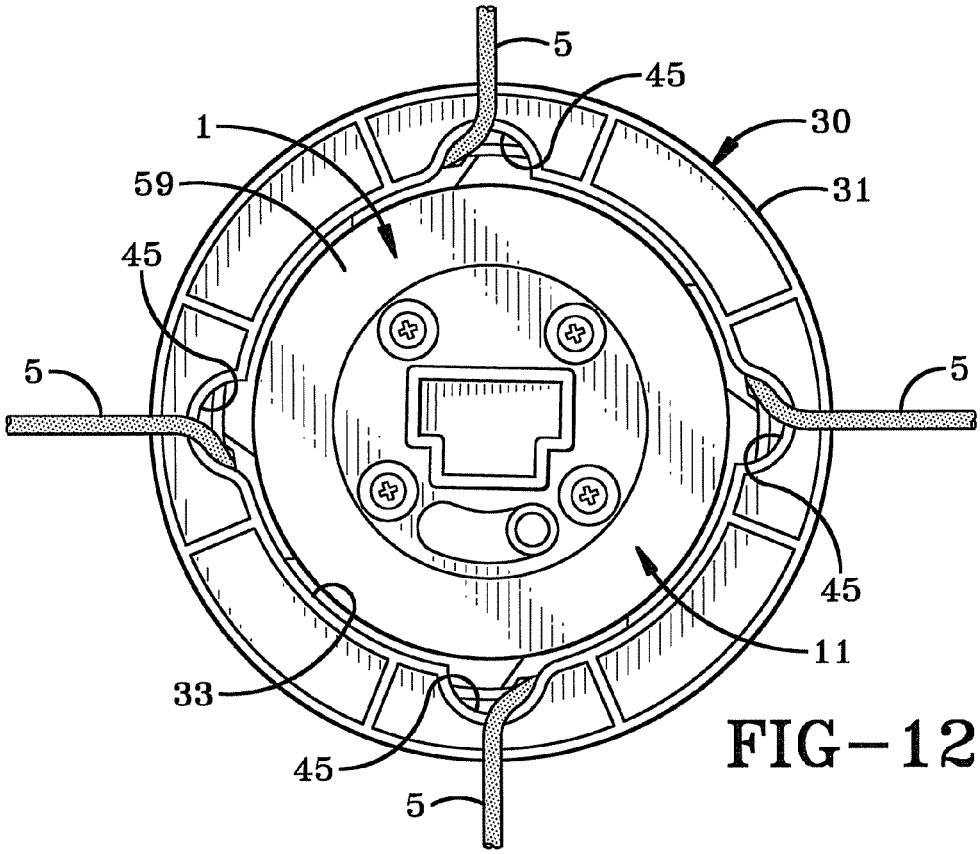
FIG. 12 is a bottom plan view of FIG. 11.

In accordance with the present invention, in order to reduce the amount of force F from being exerted directly onto the ratchet mechanism, a first embodiment of a tension reducer indicated generally at 30, and shown in FIGS. 8-12, is mounted on security device 1. Tension reducer 30 includes an annular collar 31 having a central opening 33 and is provided with a plurality of upstanding arcuate-shaped projections 35, each of which is formed with one or more one-way snap-fit tabs 37. Tabs 37 are adapted to be snap-fitted into aligned openings 39 formed in side wall 41 (FIG. 9) of security housing 11 to securely attach tension reducer 30 onto the bottom of security device 1. The inner peripheral wall 43 of collar 31 which forms central opening 33, preferably is formed with an outwardly extending recess 45 between each of the arcuate projections 35, which recesses are adapted to receive one of the cable loops 5 therein as shown particularly in FIGS. 9-12. Recesses 45 preferably are positioned with respect to housing openings 7 closely adjacent the outer edges 47 of openings 7 as shown in FIG. 10, than with respect to the opposite edges 49 of openings 7. This arrangement enables the inner portion of cable loop 5 indicated at 5A, to extend generally in a straight tangent from spool 15 before making an abrupt downward turn through recess 45 and beneath collar 31 before extending along the top surface of object 3 as shown in FIG. 11. This forms nearly an abrupt 90° change in direction of each cable loop 5 as they pass through recess 45 and beneath collar 31. It has been found that when force F is exerted on cable 5, the amount of the force exerted on spool 5 and ratchet mechanism 13 is reduced considerably due to the frictional engagement of cable loop 5 moving through an approximate 90° direction when passing beneath collar 31 prior to entering substantially tangentially with respect to spool 15 as best shown in FIGS. 9-12. Heretofore, force F would be exerted nearly directly in the tangential direction on the spool as shown in FIG. 4 applying the full force on the spool and ratchet mechanism resulting in possible disengagement of the mating gear teeth.

Figure 14:
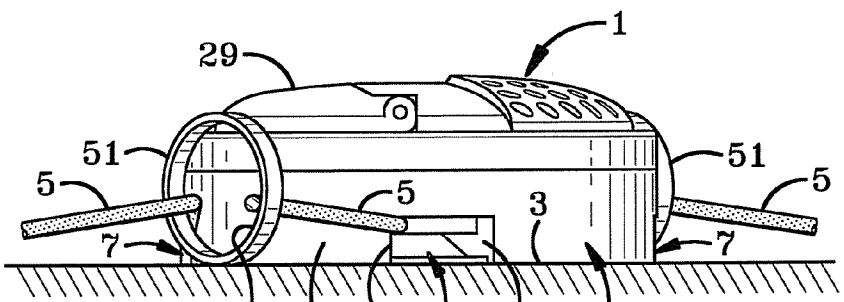
FIG. 14 is a side elevational view of the tension reducing device as shown in FIG. 13.
Figure 13:
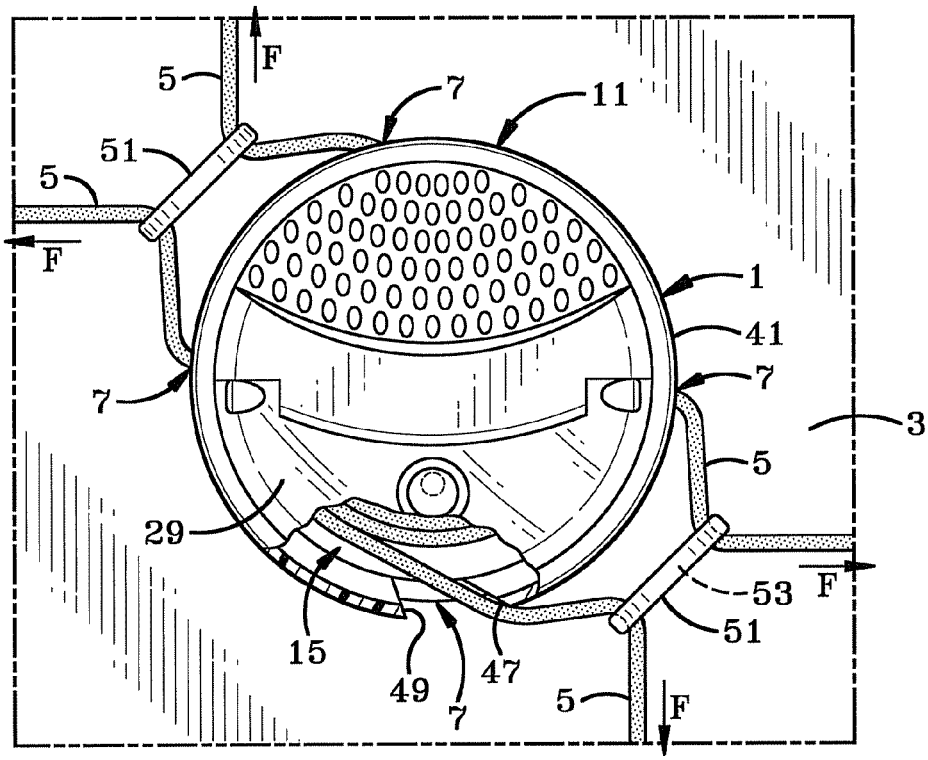
FIG. 13 is a top plan view with portions broken away in section showing a second embodiment of the tension reducing device of the present invention.

A second embodiment of the tension reducer which will achieve a similar abrupt change of direction of cable loops 5 is shown particularly in FIGS. 13 and 14. This embodiment includes the use of an annular ring 51 which will be located between adjacent housing openings 7 as shown in FIG. 13. Adjacent pairs of cable loops 5 will pass through a central opening 53 of ring 51 before extending outwardly along the adjacent surface of object 3. With this arrangement, security device 1 lies flatter against the top surface of object 3 as shown by comparing FIGS. 1 1 with that of FIG. 14, yet still provides the abrupt approximately 90° change in direction of the cable loops after exiting housing openings 7 as shown in FIG. 13. Thus, again, when a large force F is exerted on the cable loops, it is considerably reduced due to the change of direction of the cable loops and resulting frictional force created thereby as they pass through ring 51 before entering in a generally tangential direction about the spool as shown in FIG. 13.

Figure 15:
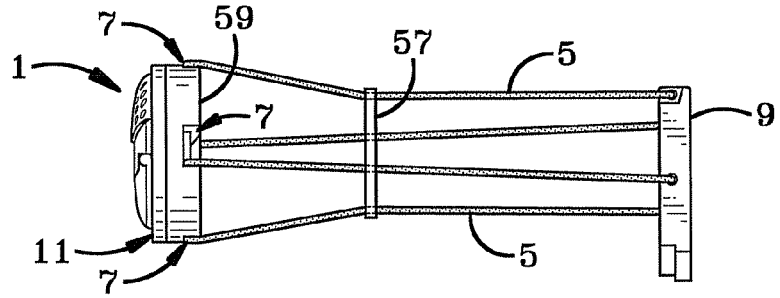
FIG. 15 is a side perspective view showing a third embodiment of the tension reducing device of the present invention.
Figure 16:
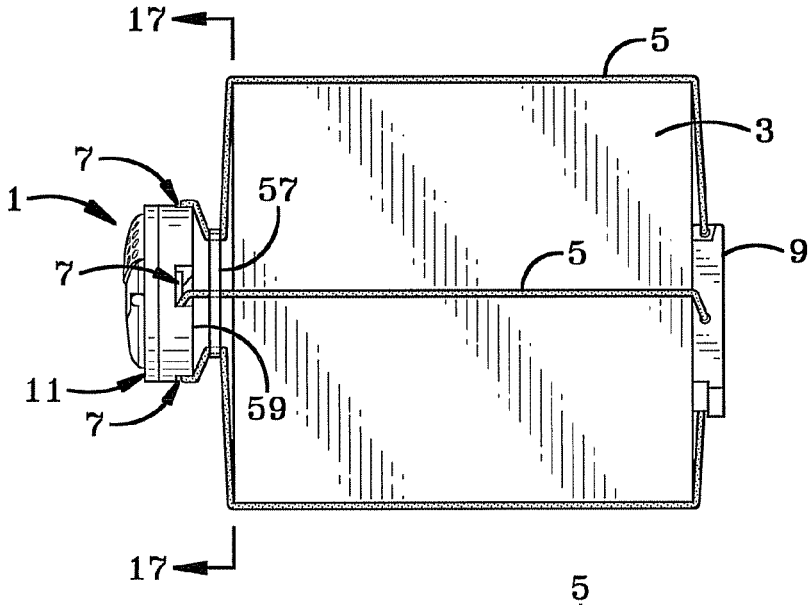
FIG. 16 is a side elevational view showing the embodiment of FIG. 15 mounted on a package.
Figure 17:
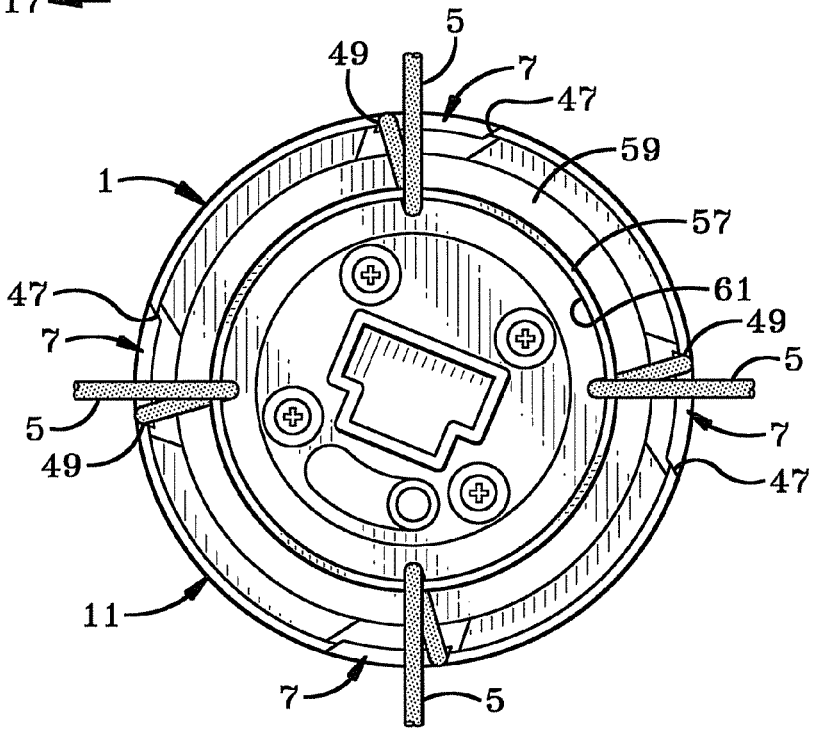
FIG. 17 is a sectional view taken on line 17-17, FIG. 16.
Figure 18:
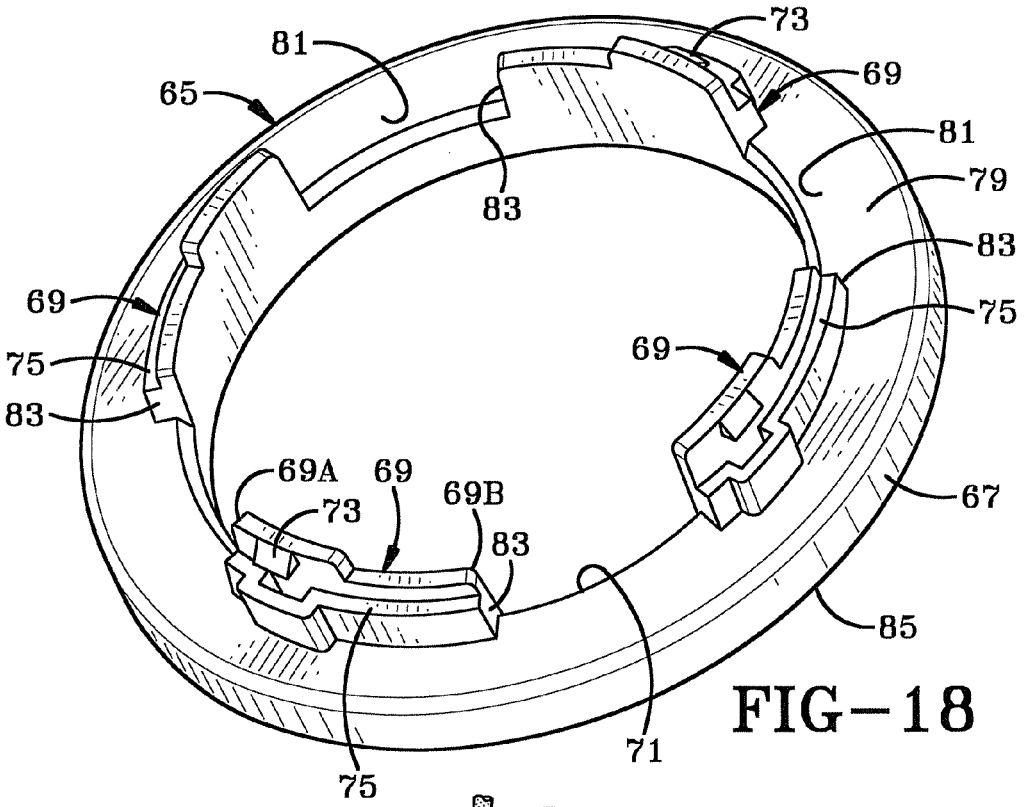
FIG. 18 is a top perspective view of another embodiment of a tension reducing collar of the present invention.
Figure 19:
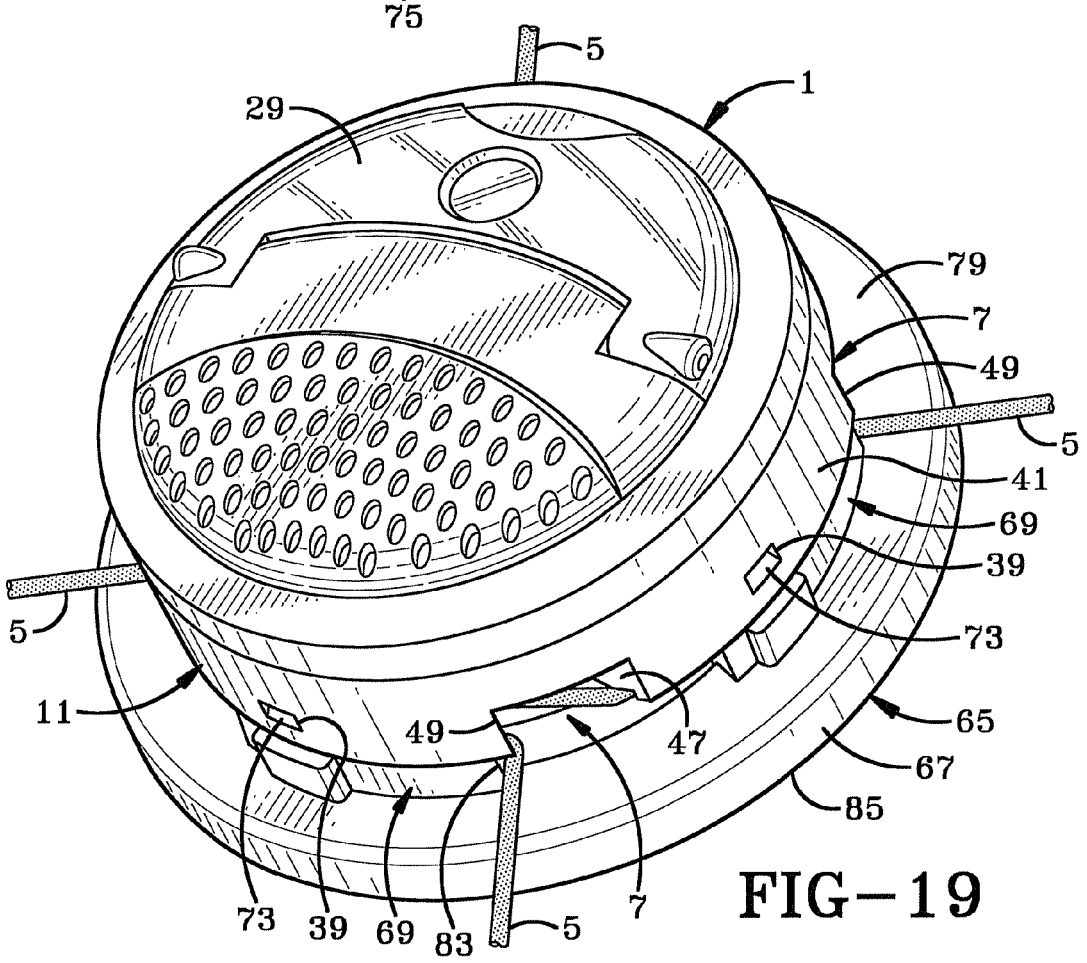
FIG. 19 is a top perspective view of the tension reducing collar of FIG. 18 mounted on a cable wrap security device.

Another embodiment of the tension reducer of the present invention is shown in FIGS. 15-17 and is indicated generally at 55. Embodiment 55 is similar in many respects to the use of the pair of annular rings 51 of FIGS. 13 and 14, but uses a single ring 57, which preferably is larger than ring 51. Ring 57 is located beneath the bottom surface 59 of security device 1 wherein all four cable loops 5 upon exiting housing 11 through openings 7 extend partly along bottom surface 59 and then pass through central opening 61 of ring 57 before extending outwardly along the top surface of object 3. As shown in FIGS. 16 and 17, cable loops 5 have an abrupt change of direction, approximately 180°, before entering into the interior of housing 11. Ring 57 preferably is formed of metal and will have a relatively small cross section so as to enable security housing 11 to lay relatively flat against the top surface of object 3 when mounted thereon in a similar manner as discussed above with respect to security device 1 as shown in FIG. 11. Embodiment 55 thereby requires only a single ring instead of a pair of the smaller rings 51 of the second embodiment while still providing the same desired abrupt change in direction of the cable loops before they enter in a generally tangential direction into housing 11 and then onto spool 15.

A fourth embodiment of the cable tension reducer of the present invention is indicated generally at 65 and is shown in FIGS. 18-21. Tension reducer 65 includes a circular snap-on collar 67 which is very similar to collar 31 of tension reducer 30 shown in FIG. 8. Tension reducer collar 67 has four arcuate-shaped projections 69 formed integrally thereon which extend about a central opening 71. A snap-fit tab 73 is formed adjacent one end of each projection 69 and is snap-fitted into aligned openings 39 formed in sidewall 41 (FIG. 19) of cylindrical housing 11 to securely attach collar 67 onto the bottom of security device 1 in a similar manner as is collar 31 attached to housing 11. Projections 69 have a stepped configuration which form an annular ledge 75 on which the bottom edge of housing sidewall 41 seats when tabs 73 extend through openings 39. This provides a space 77 between top surface 79 of collar 67 and bottom surface 59 of housing sidewall 41. Arcuate projections have an arcuate length of approximately 50° and provide spaces 81 for the passage of cable loops 5 between adjacent projections. Each projection 69 has a first end 69A adjacent snap-on tab 73 and a second end 69B.

Figure 21:
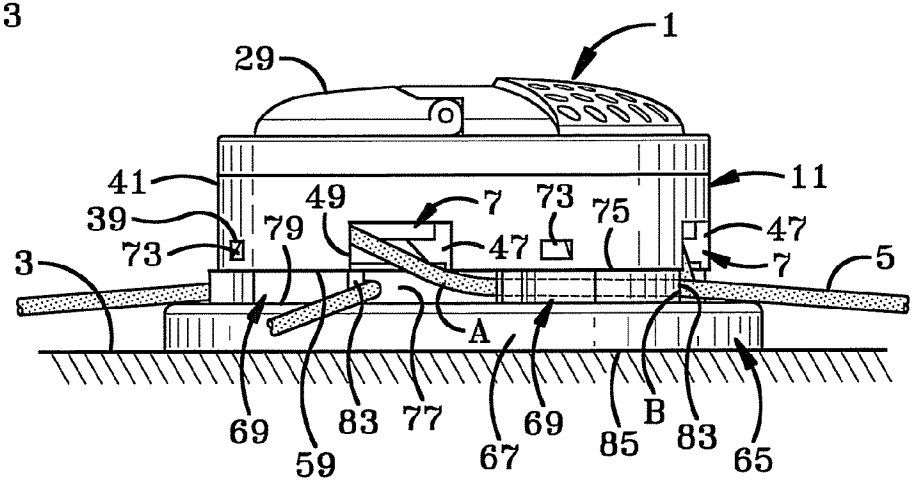
FIG. 21 is a side elevational view of the tension reducer of FIG. 20 mounted on a package.
Figure 20:
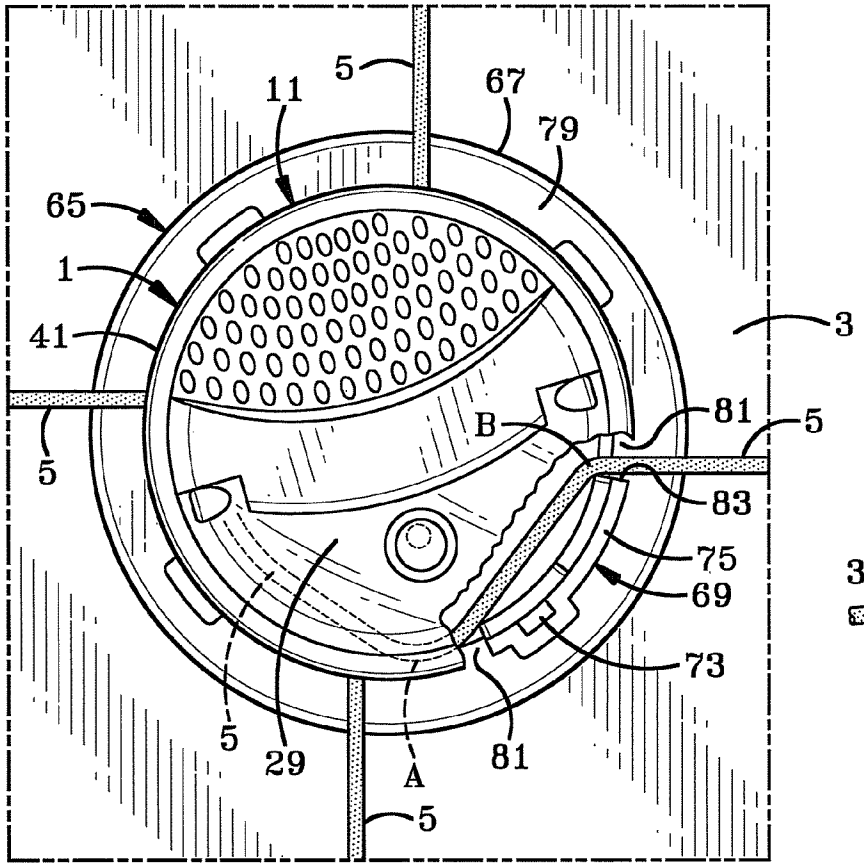
FIG. 20 is a top plan view of the tension reducer of FIG. 18 with portions broken away and in section mounted on a package.

The cable loops 5 after exiting through openings 7 of spool housing sidewall 41 in a generally tangential direction will have a first change in direction indicated by letter A as shown in FIGS. 20 and 21 where they engage a bottom end of edge 47 of openings 7 and then move along the inside surface of arcuate projections 69 as shown in FIG. 20, until exiting through spaces 81 where they abruptly change direction as shown by letter B and turn about edges 83 of projection ends 69B. Again this abrupt change in direction of the cable loops and their engagement with portions of collar 67 results in forces that are exerted on cable loops 5 of security device 1 to be exerted initially on projections 69 of collar 67 instead of being transmitted through the spool housing openings 7 and directly on the internal spool and its ratchet mechanism. This abrupt change in direction creates a large frictional force on the cable loops as they extend through an approximate 90° angle before entering the spool housing and avoids the force from being exerted directly on the spool housing and on edge 49 of spool housing opening 7 as shown in FIG. 4.

One advantage of collar 69 with respect to collar 31 is that the cable loops extend between the top surface 79 of collar 67 and bottom surface 59 of housing 11 when passing through spaces 81 between projections 69. This enables bottom surface 85 of collar 67 to rest directly upon the surface of an object 3 being secured thereby, instead of between the bottom surface of the collar and the object as does the cable loops when used with collar 30 as shown in FIG. 11. This provides for a more compact mounting of the security device having collar 67 snap-fit mounted thereon than when using the tension reducing rings and snap-on collar 31 of the previously described embodiments.

The tension reducers of the present invention can have other configurations than annular collars 31 and 67, and rings 51 and 57 without affecting the concept of the invention so long as it provides some type of abrupt change in direction of the cable loops shortly after they exit the security device housing side wall openings. This change in direction which is usually between 90° and 180°, results in a large sliding frictional force being exerted on the cable loops as they engage and move about the contacting surface of the collar and/or annular rings reducing the force being exerted directly on the spool housing at the cable exit opening thereof. It has been found that the reduction of the heretofore applied abrupt force on the cable loops at the spool housing exit openings is absorbed sufficiently by the tension reducer, whether it be a ring or collar, to prevent damage and unlatching of the internal ratchet mechanism.

It is also understood that annular collars 31 and/or 67 can be formed integrally with security device housing 11 or be a retrofit item which is attached thereto in various manners such as the one-way snap fit attachment of tabs 37 and 73 in housing holes 39. Preferably, collars 31 and 67 and arcuate projections 35 and 69 are integrally molded as one-piece members of a rigid plastic material with rings 51 and 57 preferably being formed of metal. It is also readily understood that the tension reducers do not materially affect the manner and use of security device 1, nor interfere with the placement of the cables about an object and the subsequent tensioning of the cable loops by rotation of the internal ratchet mechanism in a manner well-known in the art. Furthermore, although the abrupt change in direction is shown to be generally between 90° and 180°, lesser changes in direction still would provide sliding friction on the cable loops to assist in reducing the force from being exerted directly on the ratchet mechanism.

Thus, in accordance with the invention, the tension reducing devices, whether it be the single or plural metal rings or snap-on collars, will provide an abrupt change in direction of the cable loops after the cable loops leave the spool housing openings in a generally tangential direction, just prior to the cable loops extending along the object being protected thereby. This abrupt change of direction exerts a large frictional force on the cable loops when a sudden force is applied thereto considerably reducing the amount of force which is transmitted from the cable loops onto the internal spool of the housing. Heretofore, this force was exerted directly onto the edge of the spool housing openings where much of the force was transmitted directly onto the internal spool and correspondingly the ratchet mechanism. Heretofore, this force could cause the ratchet locking mechanism to prematurely release, providing free-wheeling of the cable loops. Thus, the tension reducing devices of the present invention provide an abrupt change in direction of the cable loops and resulting large frictional forces to be exerted on the cable loops after the cable loops leave the housing openings in generally tangential directions before moving across and around the object being protected thereby.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A security device adapted to be placed on an object to prevent said object from being opened, said device comprising:

a housing;

a plurality of cable loops extending outwardly from the housing for placement about the object;

a ratchet mechanism located within the housing and operatively connected to the cable loops, said ratchet mechanism operatively connected to a rotatable spool for maintaining the cable loops tensioned around the object;

a plurality of openings formed in the housing for passage of the cable loops therethrough for placement about the object; and a tension reducing device operatively engageable with the cable loops generally adjacent the housing openings for abruptly changing the direction of said cable loops after passing of said loops in a generally tangential direction out of the housing openings prior to said loops extending about the object; said tension reducing device including a collar mounted on the housing and formed with a plurality of openings located adjacent to the housing openings requiring the cable loops to abruptly change direction and pass beneath said collar when placed about the object; and wherein the collar is snap-fitted onto the housing by a plurality of tabs formed on one of the housing and collar and engageable in holes formed in the other of the collar and housing.

2. The security device defined in claim 1 wherein the collar is an annular ring having a plurality of arcuate projections; and in which the collar openings are outwardly extending recesses formed in the collar between adjacent pairs of the projections for directing the cable loops beneath the collar and then about the object.

3. The security device defined in claim 1 wherein the abrupt change of direction of the cable loops is generally between 90° and 180°.

4. The security device defined in claim 1 wherein the collar is formed with a plurality of spaced arcuate projections for contacting the cable loops after the cable loops pass out of the housing openings in the generally tangential direction prior to abruptly changing the direction of the cable loops when placed about the object.

5. The security device defined in claim 4 wherein each of the cable loops is located adjacent an inside surface of one of the arcuate projections prior to abruptly changing direction at an end edge of said projection.

6. The security device defined in claim 4 wherein a snap-fit tab is formed on each of the arcuate projections; and in which the collar, arcuate projections and tabs are formed as a one-piece member of a rigid plastic material.

7. In combination an object and a security device removably mounted on the object; said security device having a housing formed with four housing openings and a plurality of cable loops extending from the housing through said openings and wrapped around the object; said security device including a ratchet mechanism contained in the housing and a rotatable spool to which the cable loops are attached; said security device further includes a tension reducing member operatively engaged with the cable loops for abruptly changing the direction of said loops as they exit in a generally tangential direction from the housing and wrap around the object, said tension reducing member includes a collar formed with four openings respectively adjacent the four housing openings for directing the cable loops beneath the collar and then about the object.

8. A security device adapted to be placed on an object to prevent said object from being opened, said device comprising:

a housing;

a plurality of openings formed in the housing;

a plurality of cable loops extending outwardly from the housing through the openings for placement about the object;

a ratchet mechanism located within the housing and operatively connected to the cable loops, said ratchet mechanism operatively connected to a rotatable spool for maintaining the cable loops tensioned around the object;

a tension reducing device operatively engageable with the cable loops generally adjacent the housing openings for abruptly changing the direction of said cable loops after passing of said loops in a generally tangential direction out of the housing openings prior to said loops extending about the object, said tension reducing device including a collar mounted on the housing, said collar having a plurality of upstanding projections which mount the collar in a spaced relationship on the housing and having openings formed in the collar between adjacent pairs of the projections for directing the cable loops through the collar openings and beneath the collar and then about the object requiring the cable loops to abruptly change direction when passing through the collar openings and beneath the collar when placed about the object.

9. The security device defined in claim 8 wherein the collar is snap-fitted onto the housing by a plurality of tabs formed on one of the housing and collar and engageable in holes formed in the other of the collar and housing.

10. The security device defined in claim 8 wherein the collar is snap-fitted onto the housing by a plurality of tabs formed on one of the housing and collar and engageable in holes formed in the other of the collar and housing.

11. A security device adapted to be placed on an object to prevent said object from being opened, said device comprising:

a housing;

a plurality of cable loops extending outwardly from the housing for placement about the object;

a ratchet mechanism located within the housing and operatively connected to the cable loops, said ratchet mechanism operatively connected to a rotatable spool for maintaining the cable loops tensioned around the object;

a plurality of openings formed in the housing for passage of the cable loops therethrough for placement about the object; and a tension reducing member operatively engageable with the cable loops generally adjacent the housing openings for abruptly changing the direction of the cable loops after passing of the loops out of the housing openings prior to said loops extending about the object, wherein said tension reducing member is snap-fitted to the housing.

* * * * *